United States Patent [19]

Wortley

[11] 4,319,977

[45] Mar. 16, 1982

[54] TWO-LAYER CORRUGATED ELECTRODE

[75] Inventor: John P. A. Wortley, Harborne, England

[73] Assignee: IMI Kynoch Limited, Birmingham, England

[21] Appl. No.: 143,149

[22] Filed: Apr. 23, 1980

[30] Foreign Application Priority Data

Apr. 28, 1979 [GB] United Kingdom ..... 14845/79

[51] Int. Cl.[3] ..... C25B 11/02; C25C 7/02

[52] U.S. Cl. ..... 204/280; 204/286

[58] Field of Search ..... 204/280, 286, 297 R, 204/279, 297 W

[56] References Cited

U.S. PATENT DOCUMENTS

| | | | |
|---|---|---|---|
| 2,735,812 | 2/1956 | Van Hoek | 204/279 X |
| 3,929,607 | 12/1975 | Krause | 204/286 |
| 3,981,790 | 9/1976 | Olson et al. | 204/286 |
| 4,064,031 | 12/1977 | Kamarian | 204/256 |

FOREIGN PATENT DOCUMENTS

| | | |
|---|---|---|
| 352104 | 7/1931 | United Kingdom . |
| 581549 | 10/1946 | United Kingdom . |
| 658150 | 6/1948 | United Kingdom . |
| 730649 | 5/1955 | United Kingdom . |
| 859723 | 1/1961 | United Kingdom . |
| 951766 | 3/1964 | United Kingdom . |
| 1206021 | 9/1970 | United Kingdom . |
| 1460089 | 12/1976 | United Kingdom . |
| 1476055 | 6/1977 | United Kingdom . |

*Primary Examiner*—F. Edmundson

*Attorney, Agent, or Firm*—Cushmn, Darby & Cushman

[57] ABSTRACT

Electrode, particularly an anode, for use in electrometallurgical cells in which the electrode is formed of two very thin sheets of titanium which are corrugated and arranged in a mirror image position, being spot welded where they touch each other and being spot welded to a titanium sheathed hanger bar. The electrode, which is particularly suitable as an anode, can be formed from very thin titanium and has enhanced stiffness resulting from the corrugations which strengthen the overall construction.

8 Claims, 8 Drawing Figures

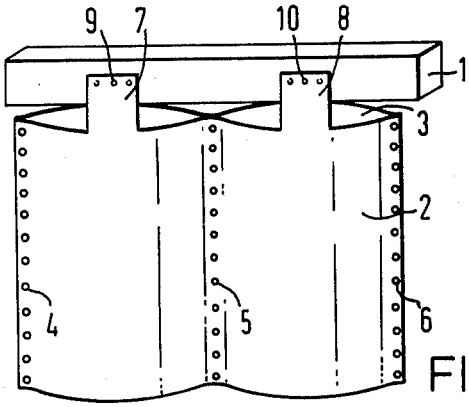
FIG. 1
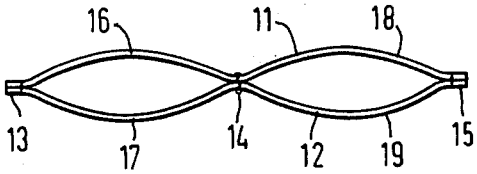
FIG. 2
FIG. 3
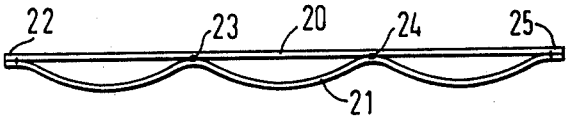
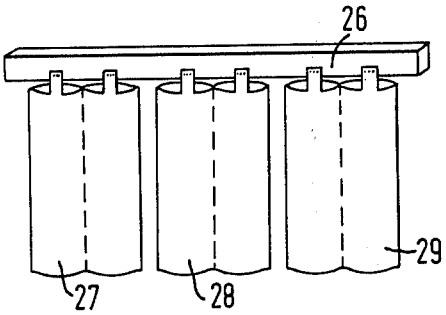
FIG. 4
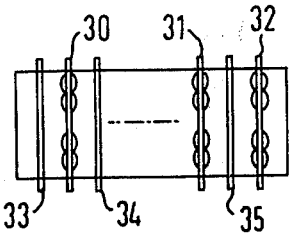
FIG. 5

TWO-LAYER CORRUGATED ELECTRODE

BACKGROUND OF THE INVENTION

This invention relates to electrodes and has particular reference to electrodes for use in the electrolytic production of manganese dioxide.

The use of permanent titanium electrodes in electrometallurgy is increasing. The permanent titanium electrodes show advantages over the other materials in their durability and in their ability to produce good electrodeposits on a long-term basis. Unfortunately, however, titanium is an expensive metal and there are, therefore, substantial advantages to be obtained from using as small a quantity of titanium as is possible.

The introduction of the all-welded hanger bar units, as are, for example, described in British Pat. Nos. 1,415,793 and 1,460,089, has led to a general approval of these types of electrodes as suitable for use as cathodes in metal electrowinning and electrorefining. The overall durability of the electrodes is very good and the general appearance and resistance of the electrodes to damage is also good. For the reasons mentioned above, however, it is desirable to reduce the thickness of titanium to as thin a level as possible. The conventional thickness for titanium electrodes is of the order of 4 mm and there have been proposals to make sandwich-type constructions in which a core metal is coated with titanium on both sides and this core metal is, therefore, a means of reducing the cost of the electrode. Unfortunately, however it has proved to be very difficult to produce a commercial product by this method because the cost of forming the construction is high and the problems associated with cutting the electrodes or piercing the outer layer of material have so far proved insuperable.

Other methods of enhancing the rigidity of the electrodes used in electrolytic processes are to be found in British Pat. No. 951,766. This shows an electrode consisting essentially of a corrugated sheet of metal such as titanium, tantalum, niobium or zirconium and the corrugations may be in the form of rectagular waves or may even be re-entrant as are shown in FIGS. 1 and 2. Attempts have been made to produce corrugated sheets of material which are sufficiently strong as to be useful but sufficiently thin as to be economic. It has been found, however, that the reduction in thickness which can be afforded by corrugating the sheets is very small and the reduction in thickness hardly pays for the cost of corrugation. Overall, therefore, simple corrugated sheets have not proven to be economically viable in the thicknesses desired.

Anodes for use in the production of chlorine by the electrolytic diaphragm cell method are described in British Pat. No. 1,181,659. These anodes basically comprise a pair of rectangular titanium sheets which are formed into the shape of an open box and are spot welded along their edges. Tabs integral with the sheets are connected to a conductor bar. It is stated that the structure may be strengthened by ribbing of the parallel plates, but no details of such ribbing are given. It is not fully understood what is meant by the word ribbing.

There exist in the chlorine industry a number of examples of electrodes which are manufactured from two or more elements. These electrodes are normally connected by a central pole to a current feeder. An example of such a design is to be found in U.S. Pat. No. 3,795,603 or U.S. Pat. No. 3,746,631.

In U.S. Pat. No. 3,379,627 there is described an anode for the manufacture of oxygen-containing derivative of olefins and this anode is shown to be in the form of contiguous tubes connected at their lower end to a pair of current lead-in members. A similar design of anode is illustrated in FIG. 18 of U.S. Pat. No. 3,342,717, which states, in column 19, line 22, that the design may be fabricated by extrusion or machining.

A foraminate anode basket has also been proposed, see British Pat. No. 1,433,800, FIG. 3, in which corrugated foraminate members are welded to a hanger bar. Such anodes are not, however, intended for use in circumstances where a product is deposited electrolytically onto their surfaces.

It can be seen, therefore, that the prior art anodes of complex shape have not been proposed for uses in which a metal or metal oxide deposited onto the surface of the electrode in use. Where the electrodes have been used in circumstances such that a material is physically deposited on their surfaces the electrodes have heretofor been of simple planar shape.

SUMMARY OF THE INVENTION

By the present invention there is provided an electrode for use in the electrolytic production of manganese dioxide comprising two continuous sheets of metal joined in face to face relationship, one at least of the sheets being corrugated so as to provide rigidity to the electrode, the two sheets being joined to a hanger bar.

Both of the sheets may be corrugated. The corrugations may be arranged as mirror images of each other. The sheets may be welded together, the welding may be by spot or seam welding. The sheets may be rivetted together. The sheets may be bolted or stitched together.

The sheets may be of titanium and may have a thickness in the range of 1.5 mm to 0.25 mm, preferably 1 mm to 0.5 mm, preferably 0.7 mm. The sheets may be attached at one end to a hanger bar. The corrugations may be perpendicularly disposed relative to the hanger bar. Each hanger bar may have a plurality of pairs of sheets attached to it.

The sheets may have integral tabs connected to the hanger bar. The hanger bar may be a two-component hanger bar having a titanium portion and a portion of a metal having a greater electrical conductivity to the titanium. The metal may be chosen from the group copper and aluminium. The tabs may be welded to the titanium portion of the hanger bar.

There may be a plurality of sheets of metal in the form of strips, the strips being disposed substantially perpendicularly to the hanger bar and being staggered along the length of the hanger bar so as to form a continuous sheet, each sheet, with the exception of the end sheets, having two or more corrugations.

The present invention also provides an electrolytic cell incorporating an electrode as herein defined and further provides a method of electrolytically producing manganese dioxide by immersing an electrode as hereinabove defined into a solution of manganese sulphate and sulphuric acid and electrolytically depositing the manganese dioxide onto the electrode and periodically removing the material.

BRIEF DESCRIPTION OF THE DRAWINGS

By way of example embodiments of the present invention will now be described with reference to the accompanying drawings, of which:

FIG. 1 is a perspective view of an electrode in accordance with the invention;

FIG. 2 is a plan view of two sheets;

FIG. 3 is a plan view of an alternative form of construction;

FIG. 4 is a perspective view of an alternative form of electrode;

FIG. 5 is a plan view of an electrowinning cell incorporating electrodes in accordance with the present invention.

DESCRIPTION OF THE PREFERRED EMBODIMENTS

Figure 6:
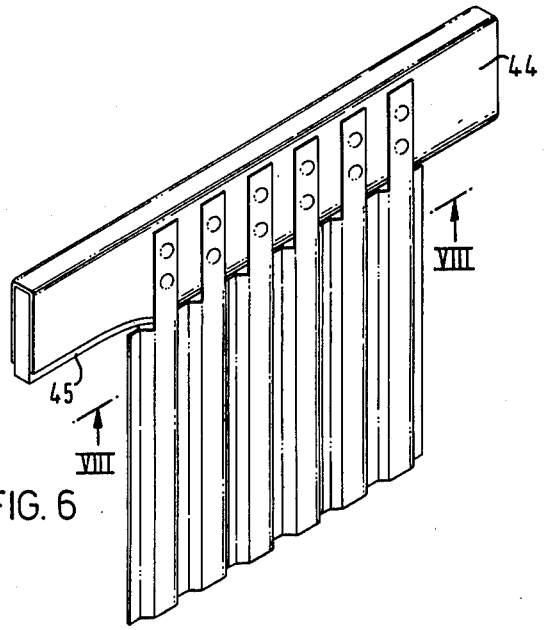
FIG. 6 is a perspective view of an alternative form of electrode.

Referring to FIG. 1 this shows a hanger bar 1 which is formed from a core of copper having an outer sheath of titanium to which is welded a construction comprising a pair of titanium sheets 2, 3. The sheets are corrugated and are spot welded together along the lines 4, 5 and 6. The sheets have integral ears such as 7 and 8 which are spot welded at 9, 10 to the hanger bar 1. The electrode is manufactured by forming thin sheets of titanium having a thickness of approximately 0.7 mm into strips and then corrugating the strips. The strips are then placed in face to face mirror image relationship and spot welded together. The strips are then machined away to level the protruding tabs or ears 7 and 8. These tabs are then directly spot welded to the hanger bar.

As is shown in FIG. 2 the two sheets 11, 12 may be both formed into corrugated sinusoidal waves and spot welded together as at 13, 14 and 15. The ears or tabs 16, 17, 18, 19 are left integral with the sheets by machining away excess titanium. It will be appreciated, however, that in an alternative form of construction the tabs may be formed from separate titanium strips spot welded to the main bodies of the electrode sheets.

It can also be readily appreciated that only one of the sheets may be corrugated as is illustrated in FIG. 3. Sheet 20 is a flat sheet to which a corrugated sheet 21 is spot welded along four lines 22, 23, 24 and 25. As is shown in FIG. 4 the hanger bar 26 may have more than one set of pairs of titanium sheets suspended from it. In FIG. 4 three sets 27, 28, 29 are shown. Any desired number of sets may be used and, in particular, four, five or six sets may be a desirable number.

As is illustrated in FIG. 5 the electrodes manufactured in accordance with the invention can be used in electrowinning or electrorefining cells. The electrodes, in this case anodes, are positioned in the cells as at 30, 31, 32 and alternate with cathodes 33, 34, 35 throughout the length of the cell.

Figure 7:
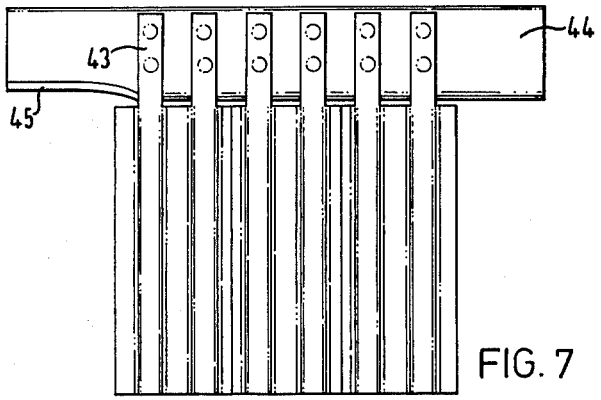
FIG. 7 is a front elevational view of the electrode of FIG. 6.
Figure 8:
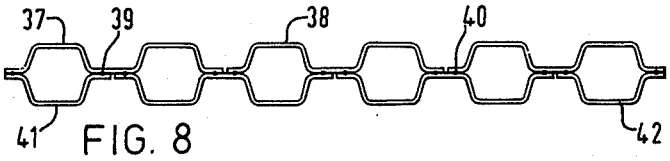
FIG. 8 is a sectional view of the electrode of FIG. 6 taken along the line VIII—VIII.

The electrode illustrated in FIGS. 6 to 8 is formed of a plurality of strips of titanium which are spot welded to a hanger bar. As can be seen most clearly in FIG. 8 the strips, such as strip 36, are formed with a pair of troughs and the strips are staggered from side to side. Thus, strip 36 is staggered with strips 37 and 38. The strips are spot welded together by means of spot welds 39, 40. At each end there is provided a half strip with a single corrugation, such as strips 41, 42, which complete the structure. The strips are formed with integral tabs, such as tabs 43, which are spot welded to the hanger bar 44. The hanger bar preferably comprises a copper cored titanium hanger bar in which the titanium is relieved at one end, such as at 45, to permit the hanger bar to engage the conventional current busbar when in use. The electrode thus forms a series of integral tubes which are dependent from the hanger bar 44 as is shown most clearly in FIG. 6.

It will be appreciated that the titanium strips need not be corrugated in a sinusoidal manner. They could be corrugated in V-shapes or in any other shape, although sinusoidal corrugations are preferred in that there is less tendency for them to promote discontinuous deposits on their surfaces when they are operating in the cell.

Having now described the form of the electrode the use of the electrode in the electrolytic production of manganese dioxide will be explained.

Manganese dioxide is conventionally formed by electrolytic deposition onto an anode. It is not clear whether the manganese dioxide is electrolytically deposited directly onto the anode or whether nascent oxygen is produced at the anode which combines with the manganese ions in the solution to form manganese dioxide which is then deposited on the anode. The conventional anodes used in the electrolytic production of manganese dioxide are graphite. These anodes are inserted into a solution of manganese sulphate and sulphuric acid and the manganese is periodically removed by chipping or cracking the manganese dioxide off of the anode. The majority of manganese dioxide produced by the electrolytic deposition route is used as a depolariser in dry batteries. The quality of the batteries is significantly affected by the quality of the manganese dioxide. Although the majority of manganese dioxide is currently produced on graphite anodes, a proportion is produced on flat planar titanium anodes. It has now unexpectedly been found that a higher quality of manganese dioxide can be produced on corrugated anodes of the present invention than on flat planar titanium anodes manufactured from identical titanium sheets. It is believed that the reason for this is that it can be observed that no exfoliation of the manganese dioxide deposit occurs on the corrugated sheet. With corrugated sheets of the present invention the manganese dioxide remains substantially smooth and crack-free. However, when manganese dioxide is electrodeposited directly onto flat titanium surfaces it becomes exfoliated and it is believed that the acid solution gets behind the manganese dioxide layer and softens the manganese dioxide layer. It has been found that if the manganese dioxide sits in acid during the period of time needed to build up the thick layers on the anodes it softens, becomes slimey and falls off. When manganese dioxide is first deposited it is hard and the soft manganese dioxide is of poor quality. Even as little as 1% of soft manganese dioxide is highly undesirable when the manganese dioxide is used as a depolariser in batteries.

It is not clear why the corrugated sheets produce manganese dioxide deposits which are less prone to stress cracking than flat sheets. Typically the corrugations would have a pitch of 3 cm. It could be that the corrugations result in the manganese dioxide crystals growing in different directions and this results in some form of internal stress relief of the deposit. Alternatively, it might be that the flat surfaces tend to twist in use which could dislodge the electrodeposit as it is being formed and enable exfoliation of the deposit to occur.

The advantages of the use of corrugated anodes in manganese dioxide production are clear but it will be appreciated that the invention is not to be limited by reason of the explanation given for these advantages immediately above. As far as the inventor and the present applicants are aware the advantages of the use of corrugated anodes in manganese dioxide is completely unexpected.

I claim:

1. An electrode assembly comprising: an electrically conductive hanger bar having a longitudinal dimension; and an electrode formed of two continuous sheets of metal, at least one of the sheets being corrugated, the sheets being in face to face contact so as to form a series of parallel spaced-apart tubes and being joined together along their areas of contact, said electrode being joined to said hanger bar along the longitudinal dimension thereof such that said tubes extend perpendicularly to said longitudinal dimension.

2. An electrode as claimed in claim 1 in which the sheets are formed of titanium.

3. An electrode as claimed in claim 1 or claim 2 in which both sheets are corrugated.

4. An electrode as claimed in claim 3 in which the sheets are mirror images of each other and are welded together.

5. An electrode as claimed in claim 1 in which the thickness of the sheets is in the range 1.5 mm to 0.25 mm, preferably 1 mm to 0.5 mm, further preferably 0.7 mm.

6. An electrode as claimed in claim 1 in which the corrugations are perpendicularly disposed relative to the hanger bar.

7. An electrode as claimed in claim 1 in which the sheets have integral tabs connected to the hanger bar.

8. An electrode as claimed in claim 1 in which the hanger bar is a two-component hanger bar having a titanium portion and a portion of a metal having a greater electrical conductivity than the titanium, the tabs being welded to the titanium portion of the hanger bar.

* * * * *